US011111461B1

(12) United States Patent
Lupberger et al.

(10) Patent No.: US 11,111,461 B1
(45) Date of Patent: Sep. 7, 2021

(54) COCONUT-BASED LIQUID DETERGENT COMPOSITION

(71) Applicant: BOCKS INC., New York, NY (US)

(72) Inventors: Ryan Lupberger, New York, NY (US); Arianne Perry, New York, NY (US)

(73) Assignee: BOCKS INC., New York, NY (US)

( * ) Notice: Subject to any disclaimer, the term of this patent is extended or adjusted under 35 U.S.C. 154(b) by 0 days.

(21) Appl. No.: 17/169,788

(22) Filed: Feb. 8, 2021

(51) Int. Cl.

| | |
|---|---|
| ***C11D 3/04*** | (2006.01) |
| ***C11D 3/20*** | (2006.01) |
| ***C11D 3/382*** | (2006.01) |
| ***C11D 3/50*** | (2006.01) |
| ***C11D 3/37*** | (2006.01) |
| ***C11D 17/00*** | (2006.01) |
| ***C11D 3/30*** | (2006.01) |

(52) U.S. Cl.
CPC ..... *C11D 3/382* (2013.01); *C11D 3/046* (2013.01); *C11D 3/2044* (2013.01); *C11D 3/2065* (2013.01); *C11D 3/2079* (2013.01); *C11D 3/2086* (2013.01); *C11D 3/30* (2013.01); *C11D 3/3707* (2013.01); *C11D 3/3715* (2013.01); *C11D 17/0008* (2013.01)

(58) Field of Classification Search
CPC .. C11D 3/04; C11D 3/042; C11D 3/20; C11D 3/2065; C11D 3/2086; C11D 3/2093; C11D 3/382; C11D 3/50
See application file for complete search history.

(56) References Cited

U.S. PATENT DOCUMENTS

| | | | | |
|---|---|---|---|---|
| 4,642,317 | A | 2/1987 | Palmquist | |
| 6,428,776 | B1 | 8/2002 | Guckenbliehl | |
| 7,638,474 | B1 | 12/2009 | Parrish | |
| 9,301,908 | B2 | 4/2016 | Toda | |
| 9,771,549 | B2 | 9/2017 | Agarkhed | |
| 9,809,538 | B2 | 11/2017 | Musa | |
| 9,844,524 | B2 | 12/2017 | Smith | |
| 10,119,100 | B2 | 11/2018 | Ewell | |
| 10,400,196 | B2 | 9/2019 | Burgan | |
| 10,508,256 | B2 | 12/2019 | Wu | |
| 10,633,614 | B2 | 4/2020 | Smith | |
| 10,702,491 | B2 | 7/2020 | Smith | |
| 10,716,745 | B2 | 7/2020 | Leal | |
| 10,781,412 | B2 | 9/2020 | Shin | |
| 10,793,808 | B2 | 10/2020 | Smith | |
| 2010/0158964 | A1* | 6/2010 | Cunningham | A61Q 19/00 424/402 |

* cited by examiner

*Primary Examiner* — Brian P Mruk
(74) *Attorney, Agent, or Firm* — Ignacio Bellver

(57) ABSTRACT

The present disclosure provides a liquid detergent composition with a coconut-based compound for cleaning, cleansing, lubricating, and combinations thereof, that can also be packaged inside a gable-top carton without any leaking or leaching out of the gable-top carton, when other combinations of compositions, as well as certain environmental factors are also present.

7 Claims, 1 Drawing Sheet

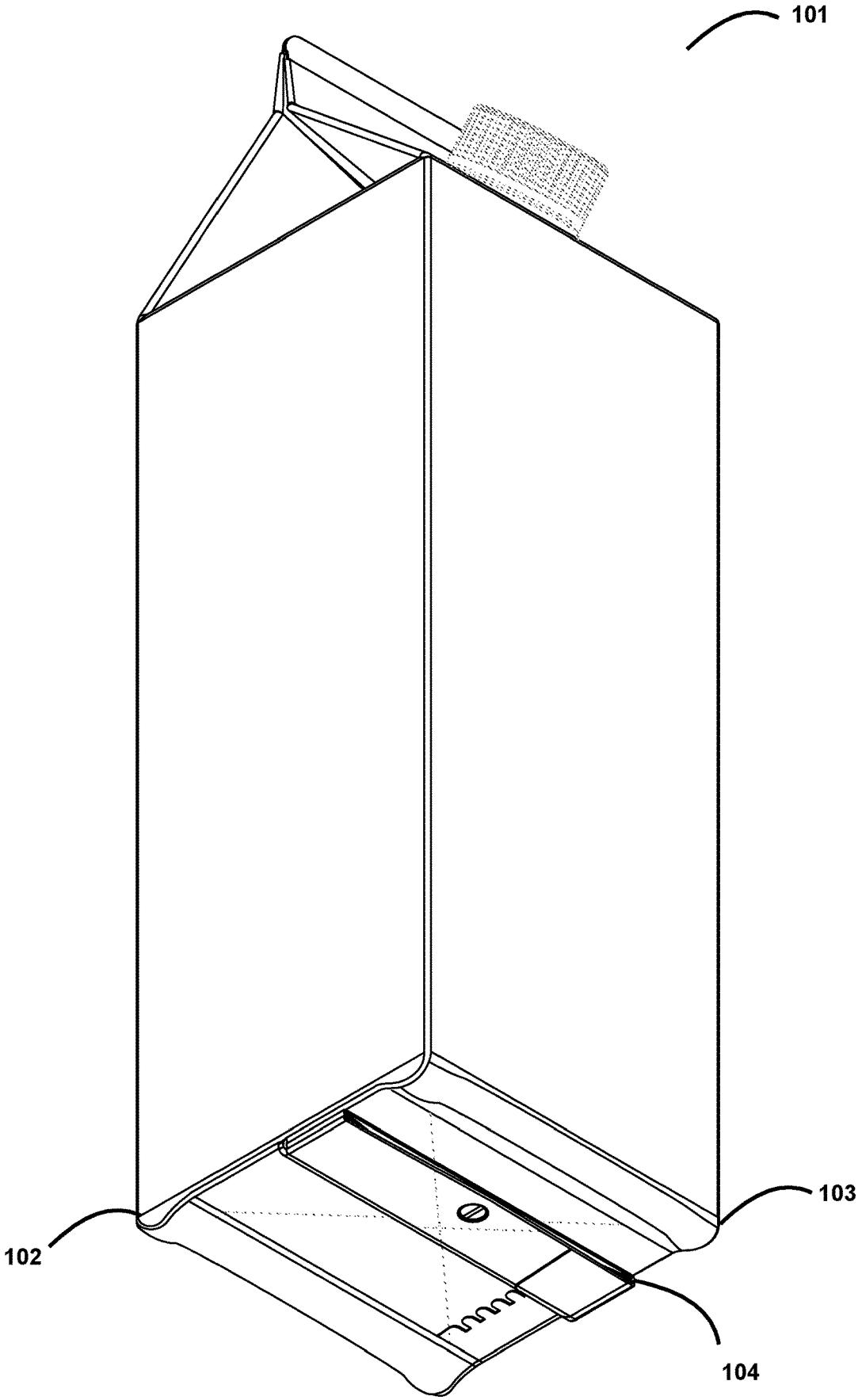
101
102
103
104

COCONUT-BASED LIQUID DETERGENT COMPOSITION

TECHNICAL FIELD

The present disclosure relates generally to a coconut-based composition of liquid detergent soaps with biodegradable compounds to be used as a refill composition, inside a recyclable gable-top carton, as alternative to the non-refillable petroleum-based oils, typically found in personal cleansing products and household products, such as hand soaps, all-purpose cleaners, laundry detergents, and dish soaps.

BACKGROUND

Liquid detergents (used interchangeably with the word "soap") are a part of every household, with mostly an everyday use. Many of these detergents are either based off surfactants or mixture of surfactants, with certain cleaning properties, diluted in either an oil-based (animal or vegetable) or water-based composition. Their origin dates back to early 2800 B.C., but it was probably only until 1791 when the process for making soda ash from common salt was discovered, and used to combine it with fat, to form soap. This discovery made soap-making one of the fastest-growing industries by 1850, along with other advancements and development of power to operate factories.

The chemistry of liquid detergent manufacturing primarily remained the same until the development of the first synthetic detergent in response to the shortage of fats for making soaps during the World War I. Commonly known as detergents today, synthetic detergents are non-soap washing and cleaning products, which are put together chemically or synthesized to produce a variety of raw materials. The proliferation of detergents was also driven by the need for a cleaning agent, which, unlike soap, would not combine with the mineral salts in water to form an insoluble substance (soap curd) on the fabric. Thereafter, more than half of the detergents were based on the formula of a propylene tetramer conjugated to benzene (PT benzene), which contained a branched chain formation of PT benzene that results in the bacteria's' inability to degrade that composition of detergent, which then cause the introduction of linear alkyl benzene molecules to aid in the degradation process whilst minimizing the environmental impact. By 1953, detergents had all but replaced soap-based products that were used for laundering, dishwashing and household cleaning.

Today, although most compositions—be it liquid or solid—are called "soap", they are indeed, detergents. In fact, it has become so common to call detergents "soaps," that most people would be confused if asked for a "liquid hand detergent" while shopping.

Furthermore, nowadays from a composition standpoint, most detergents have added compounds for either antibacterial properties, or masking fragrances. One such compound which has been used extensively in detergent formulations are harmful solvents like ammonium compounds, mercaptans, sulfides, indoles, skatoles, and thiocresols, triclocarban, (i.e., 3-(4-chlorophenyl)-1-(3,4-dichlorophenyl) urea), among others. Nonetheless, if these solvents could be substantially eliminated, the chemical odor from those materials would be eliminated as well resulting in a better consumer experience. Furthermore, fragrance development for such products would be simplified, since fragrance components that mask said harmful solvent odor would not necessarily have to be incorporated. In addition, any fragrances that are incorporated in such cleaning products would not have to compete with solvent odor, allowing for the full hedonics of the fragrance to be experienced, thereby enhancing the consumer experience as well.

On the surfactant side, detergents have been most recently made utilizing primarily linear alcohols, surfactant intermediates, such as alkyl benzenes, 2-alkyl alcohols, and which are all made from conventional feedstocks, such as petroleum-derived ethylene, kerosene, or other petrol materials. Due to the growing environmental concerns over fossil fuel extraction and economic concerns over exhausting fossil fuel deposits, there is a demand for using an alternate feedstock for producing surfactants for use in detergents. Nonetheless, not all detergent companies have the mission, or are willing to spend capital in machinery to produce detergents with renewable surfactants, like the herewith disclosed, other than the conventional methyl ester sulphonates produced today from natural oils.

On the other hand, the most common odor eliminators or odor reducers used are based on alcohol, corn and corn derivatives, probiotics, or masking fragrances. The problem with these common odor eliminators is that they do not last long enough, often requiring constant application through a misting system. Furthermore, such traditional use of odor reducer or eliminators are only temporarily effective at reducing or eliminating the airborne odor particles, including smoke and smog, and not effective at treating the odor source. In trying to overcome this problem, the detergent industry has moved to the incorporation of organosilicon compounds in their formulas, which contain certain hydrolysable groups because their biocidal or antibacterial ingredient also serves as an antifouling agent. These also have the added value of being relatively environmentally friendly, easily adhere to a surface, resist water immersion, resist high temperatures, and have the ability to repel water and dirt. Yet, there exist certain issues with the use of organosilane compositions, which involve their traditional use in liquid form, that they require methanol to prevent degradation, making them toxic, that they cannot be used in a variety of household applications, and they are just not simple to manufacture because they leach once set or cured.

Therefore, there is a continuing need for a novel and effective liquid detergent composition for cleaning applications that not only solves consumer facing problems, but also those of making it. The present invention is directed to this, as well as other, important ends.

SUMMARY

The present invention attempts to solve one or more of the abovementioned needs, by providing a liquid detergent composition based on natural oils, more particular coconut oil, in order to meet the needs of consumers who desire sustainable products with good performance at an affordable cost. The present disclosure achieves this without the use of any linear alcohol derived from a natural, renewable oil reduction (fatty alcohol or detergent alcohol); or any synthetic alcohol which may contain varying levels of 2-alkyl branched content, depending on the process used to make the synthetic alcohols, and linear content.

In one embodiment of the present invention, the liquid detergent composition uses a concentrated coconut derived natural surfactant—potassium cocoate—, with de-ionized water, as its main ingredient by percent, in order to provide the properties typically observed with non-natural surfactants which involve removing and loosing dirt and grease from the surface of objects and skin. To add to the strength of the composition of the present invention, two other compounds form part of the base composition and they are used in order to reduce the surface tension of liquids as well as preventing the compounds in the rest of the liquid detergent composition from separating into separate chemicals (i.e., potassium oleate, potassium olivate, and glycerin). The present invention is then completed with pH adjusters, humectants, a foaming boosting surfactant, salts that serve the purpose of either preservatives, electrolyte, builders and combinations thereof.

Lastly, the percentages disclosed in embodiments of the present invention are of importance not only because they are necessary to achieve the applications of cleaning, cleansing, emulsifying, dispersing, lubrication, building, adjusting, and combinations thereof, but also because embodiments of the present invention are to be packaged inside a gable-top carton that leaches out it when other combinations of compositions as well as certain environmental, are present.

As such, the various embodiments and implementations of the embodiments described herein provide a profusion of technical advantages and benefits in the areas of longevity, cleaning, cleansing, simplicity in manufacturing, adequate packaging and transportation without leaching, as well as minimizing the effects of the non-based compounds of the composition. Other technical advantages are readily apparent to one skilled in the art after review of the following description and claims associated herewith. Nevertheless, further details, examples, and aspects of the invention will still be described below in more detail.

BRIEF DESCRIPTION OF THE DRAWINGS

The teachings of the present invention can be readily understood by considering the following detailed description in conjunction with the accompanying drawings.

FIG. 1, is a top right perspective view of the gable-top corrugate carton design, used to package and transport the coconut-based liquid detergent, according to an embodiment of the present disclosure.

DETAILED DESCRIPTION

Reference will now be made in detail, to several embodiments of the present disclosures, examples of which, are illustrated in the accompanying FIGURES. It is noted that wherever practicable similar or like reference symbols may be used in the figures and may indicate similar or like functionality. The FIGURES depict embodiments of the present disclosure, for purposes of illustration only. One skilled in the art will readily recognize from the following description that alternative embodiments of the structures, systems, and methods illustrated therein may be employed without departing from the principles of the disclosure described herein.

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings.

Liquid detergents compositions have historically focused on improvements to either the effects on cleaning surfaces, or skin. This mainly because other factors outside its cleaning effects have not been of importance to consumer. Nonetheless, consumer nowadays have become so used to the efficacy of liquid detergents that when looking at innovative liquid detergent compositions, they look for more than just its cleaning power. As such, the industry started the introduction of more holistic products (i.e., products that feature other than the efficacy of a certain liquid detergent composition) in various forms, claiming to be anything from zero-waste to easy-to-pour. One thing that has not changed in this industry is how liquid detergent composition are packaged out of the factory. In fact, the liquid detergent compositions used for cleaning surfaces or skins have either used plastic or metal containers with a dispensing pump for most of their existence. Some improvements have been made to packaging of liquid composition detergents, but those mostly apply to the cleaning of clothing articles which are not the art covered by the present disclosure.

The present invention provides a novel, coconut-based liquid detergent composition, that is non-toxic, biodegradable, phthalate-free, paraben-free, allergen-free, hypoallergenic, and non-irritating that can be used as a hand soap, an all-purpose cleaner, a liquid laundry, and a liquid dish soap. The composition of the present invention not only allows for extraordinary cleaning properties, but also provides a precise formulation that is stable for transportation in gable-top corrugated cartons that has only been previously achieved by other non-cleaning products like milk or water.

As it pertains to FIG. 1, it represents the gable-top corrugated carton 101, used to contain the present coconut-based liquid detergent composition invention, in which an embodiment of the present invention is useful. Persons of ordinary skill in the art, will recognize that any paper-based material soaks up liquids, particularly those containing water. This will then cause the liquids to leach out of the paper-based material slowly through time, especially over sections 102, 103, and 104. As such, not all liquids can be transported using gable-top cartons hence the reason why the present invention was developed.

Particular embodiments herewith disclosed, use potassium cocoate as its based ingredient which is obtained after the process of coconut oil saponification. For the present invention to adequately function, the potassium cocoate that is obtained shall not contain any other by-product typically found being added during saponification, like glycerin. In fact, several trials were made using different types of saponification processes and compositions, but none were effective at being able to remain inside a gable-top corrugated carton without leaking through time. As such, for the preparation of the potassium cocoate herewith disclosed it was used potassium as its lye-base against coconut-oil which yielded a very alkaline compound, that is later adjusted as part of the finished composition (not the saponification), with no less than 0.4% wt. citric acid. The total weight percent of potassium cocoate used in the present invention is greater than 6.8%, with a typical range of 7.4% to about 14.5%.

Because of the use of coconut-based potassium cocoate in amounts higher than 6.8% wt., there existed no need to improve the cleaning power of the liquid detergent composition of the present disclosure, nonetheless, potassium oleate and potassium olivate are added in order to further promote the break down and removal of tar, soil, dirt, and oils, which respectively act on proteins, starches, pectins, and fats. These three compounds also break down and remove bacteria found. As detailed further below, the inclusion of these compounds in the present disclosure improves the cleaning performance even during cold water washes, thereby allowing a reduction in energy consumed and realizing a cost savings in the process.

Accordingly, further aspects of the invention disclose two more soap-base detergent actives that are preferably added to the composition. In particular, these are potassium oleate with a finished good weight percent greater than 6.0%, which may range from 6.2% to about 13.5%; and potassium olivate with a finished good weight percent greater than 1.2%, which may range from 1.9% to about 3.5%. Other non-soap detergent actives are further added to the composition of this invention after the saponification process. In particular, glycerin USP 99.7% vegetable is added, in a finished good weight percent greater than 0.8% to about 3.5%. In one embodiment of the invention, glycerin serves as an emollient to soften and moisturize the skin therefore decrease itching and flaking of human skin. Other embodiments of the present invention use glycerin as a solvent to loosen sticky tar, soil, or dirt. Nonetheless, the amount required by the proposed invention of glycerin is not significant because consistency is needed in the composition to be able to sustain transportation in a gable-top corrugate carton. As such, further plant-based humectants are needed, typically in the range of 0.1% to 2.0% wt., in order to supplement glycerin's softening and moisturizing effects. This is required as the present invention is to be in constant contact with human skin while being used.

In one embodiment in accordance with present principles, the coconut-based liquid detergent composition has a pH of less than 7.0 but not lower than 4.0. To achieve this, the composition includes the weak organic acid of citric acid, as a pH adjuster/buffer in combination with sodium gluconate, and sodium chloride. Nonetheless, the weak organic acid's main role is to act as a buffer and to do so, it may be present in an amount sufficient to adjust pH to below 7.0, or in the range of less than 7.0 but not lower than 4.0, or in the range of 4.0 to about 6.0, or in the range of 4.2 to 5.8, where the pH is measured at a temperature of 25 degrees Celsius.

A mixture of sodium salts between 0.3 to 2.0 percent by weight mainly consisting of Trisodium Citrate, Sodium Gluconate, Sodium Chloride, and combinations thereof are used for different purposes. In one embodiment of the present invention, Trisodium Citrate is used as a detergent builder because of the present of a weak citric acid and not typically present in the present invention on amounts greater than 1.2% wt. In contrast, sodium gluconate according to embodiments of the present invention, is used as a preservative preventing disruption of the already obtained pH, cellular leaking, and growth of microbes. The latter is of particular importance given that the gable-top corrugated carton in which the composition is to be stored and transported, is not sterilized. As it pertains to sodium chloride, it is an object of the present disclosure to use it, due to its solubility enhancement electrolytes, as an additional agent to reduce the levels of pH, and lastly as a thickening agent to prevent the consistency of the composition to be too liquid that it leaches out of the gable-top corrugated carton.

Particular embodiments of the present invention also disclose that a mixture of natural oils between 0.03 to 1.2 percent by weight are used mainly due to their emollient functions but capitalizing as well on other health associated benefits. For instance, Australian Tea Tree Oil (i.e., *Melaleuca alternifolia* 'Tea Tree' Leaf Oil) may be present in amounts greater than 0.03% wt., but less than 1.0% wt., and has been historically used as an antiseptic and anti-inflammatory. Similarly, cedarwood oil (i.e., *Cedrus Atlantica* 'Cedarwood' Bark Oil) is used due to its anti-inflammatory properties, but most importantly due to its antimicrobial ones, and may be present in amounts greater than 0.05% wt., but less than 0.1% wt. *Eucalyptus* Oil (i.e., *Eucalyptus citriodora* oil) is present to inhibit the growth and spread of bacteria on the surfaces where the present invention is to be applied. It is not present in a significant amount—typically around 0.3% wt.—in the present disclosure because it mainly acts a supplement to the aforementioned soap-bases to aid in the removal of tar, soils, and dirt. More antibacterial and antifungal properties are obtained from the present disclosure when combining the use of lemongrass oil and orange oil. Particularly, these two compounds and combinations thereof, may be present in amounts greater than 0.01% wt., but less than 1.0% wt., in order to achieve the setout goal. Lastly, from an emollient stand-point D-limonene oil and Lavender 40/42 oils are used to create the fragrance of the present invention. Typically, these compounds require standardization with a natural linalool and a linalyl acetate but given the amounts present in the present disclosure, in combination with the prior mentioned compounds, these require no further standardization. D-limonene may be present in amounts greater than 0.03% wt., but not greater than 0.5% wt. Lavender 40/42, on the other hand, may be present in amounts greater than 0.05% wt., but not higher than 1.0% wt.

A small amount of a secondary foaming boosting agent like Glutamic acid/N-diacetic acid/tetra sodium salt may be present in amounts greater than 0.5% wt., in order to also act as boosting agent for disinfecting products when high water hardness is present, to improve hard surface cleaning performance, and inhibit scale in dishwashing applications.

Other chelating agents are added to the present disclosure in order stabilize the composition which are Acrylates Copolymer, which may be present in amounts greater than 0.20% wt., Polyglyceryl-3 Caprate/Caprylate/Succinate, which may be present in amounts greater than 2.5% wt.

Comparison of the coconut-based liquid detergent composition with other commercially available liquid detergent compositions was performed and the below examples provide results of said comparison test. The data was derived according to the ASTM D 4265-98 Standard Guide for Evaluating Stain Removal Performance in Home Laundering, and ASTM D 4488-95 Standard Guide for Testing Cleaning Performance of Products Intended for Use on Resilient Flooring and Washable Walls.

Coconut-Based Liquid Detergent Composition Test Results

Soiled Panel

The following pre-Soiled panels acquired from Center for Test (CFT) Materials:

DM-08, Cheese Double Soil Load;

DM-42, Blueberry Yogurt;

DM-54, Oatmeal/Chocolate; and

DM-60, Spinach.

The reflectance of each of the groups was then measured before and after soiling using a Konica Minolta, CR410 Colorimeter (D65/2° Obs., Capitol "Y").

Sample Dilutions

All of the Samples (except Blueland®) were diluted 1.0 (±0.1 g)/L of 150 ppm Water, then heated to 117° F. before the test run.

The Blueland® directions stated to pour onto wet sponge or Dirty Dishes before cleaning dishes.

Soil Removal

A test panel was soaked for 60-seconds in the diluted sample, then mounted in the tray of a Gardner Straight-Line Washability Apparatus, adding 30 mL of the diluted sample to a water-dampened sponge in the carriage. The soil tile was then scrubbed for 10 cycles with the damp sponge. After rinsing and drying the reflectance of each test piece was measured again using the same methodology and equipment as before. Three (3) panels were cleaned with each test product.

From the reflectance of each test piece before and after soiling and after cleaning, it was then calculated the percent of soil removal, averaged them for each set of replicates, and calculated the statistically significant difference between the averages at the 95% level of confidence. The results were then totaled (Overall Soil Removal Total) for the soils for each of the products and TABLE 1 was developed. If two totals differ by less than 10%, they are said to be comparable.

TABLE 1

| | D4488 Soils | | | D5343 | Overall Soil Removal | % of |
|---|---|---|---|---|---|---|
| Samples | A2 | A3 | A5 | Soap Scum | Totals | Best |
| Formula 409 ® | 17.9 | 55.8 | 58.8 | 46.5 | 179.0 | Best |
| Present invention | 19.3 | 33.7 | 57.1 | 48.8 | 158.9 | 88.8% |
| Fantastik ® | 12.5 | 17.3 | 25.0 | 47.7 | 102.5 | 57.3% |
| ECOS ® | 3.0 | 10.2 | 30.8 | 48.7 | 92.7 | 51.8% |
| NBD ® | 4.3 | 10.2 | 24.8 | 48.7 | 88.0 | 49.2% |
| Lysol ® | 19.8 | 9.5 | 23.4 | 25.7 | 78.4 | 43.8% |
| Clorox ® Clean-Up | 9.6 | 31.4 | 24.6 | 8.5 | 74.1 | 41.4% |
| Attitude ® | 7.7 | 10.8 | 28.3 | 19.6 | 66.4 | 37.1% |
| Seventh Generation ® | 5.0 | 11.4 | 23.9 | 25.8 | 66.1 | 36.9% |
| Blueland ® | 3.0 | 9.7 | 26.7 | 21.1 | 60.5 | 33.8% |
| Method ® | 8.1 | 9.3 | 21.5 | 11.6 | 50.5 | 28.2% |
| Mrs. Meyer's ® | 4.6 | 8.6 | 20.9 | 15.7 | 49.8 | 27.8% |
| Sig. Dif. | 1.9 | 2.9 | 3.9 | 5.3 | | |

Given the above results, the data clearly indicates the technical benefits of the present invention in removing soils and scum and indicate that the preferred composition provides a robust solution for technical problems of cleaning while also being able to prevent leakage out of a gable-top corrugated carton.

The foregoing is a description of exemplary multi-purpose protectant compositions and methods. However, it is to be understood that the present disclosure is not limited to the particular descriptions disclosed. The present disclosure also comprises any modifications or equivalents within the scope of the claims.

The term "without the use of" or "substantially free" as used herein refers to either the complete absence of an ingredient or a minimal amount thereof merely as impurity or unintended byproduct of another ingredient. A composition that is "substantially free" of/from a component means that the composition comprises less than about 0.1%, 0.05%, or 0.01%, or even 0%, by weight of the composition, of the component.

As used herein, "and/or" placed between a first entity and a second entity means one of (1) the first entity, (2) the second entity, and (3) the first entity and the second entity. Multiple elements listed with "and/or" should be construed in the same fashion, i.e., "one or more" of the elements so conjoined. Furthermore, the terms "comprising," "consisting," "including," and "having," as used in the claims and specification herein, shall be considered as indicating an open group that may include other elements not specified. The terms "a," "an," and the singular forms of words shall be taken to include the plural form of the same words, such that the terms mean that one or more of something is provided. The term "one" or "single" may be used to indicate that one and only one of something is intended. Similarly, other specific integer values, such as "two," may be used when a specific number of things is intended.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Unless otherwise noted, all component or composition levels are in reference to the active portion of that component or composition, and are exclusive of impurities, for example, residual solvents or by-products, which may be present in commercially available sources of such components or compositions.

All percentages and ratios are calculated by weight unless otherwise indicated. All percentages and ratios are calculated based on the total composition unless otherwise indicated.

What is claimed is:

1. A coconut-based liquid detergent composition wherein said coconut-based liquid detergent composition being dissolvable in water yields a stable solution that can be packaged in corrugated gable-top cartons without leaking, wherein the coconut-based liquid detergent composition comprises:

greater than 60 percent by weight of de-ionized water;
greater than 6.8 percent by weight of potassium cocoate;
greater than 6.0 percent by weight of potassium oleate;
greater than 1.2 percent by weight of potassium olivate;
greater than 0.8 percent by weight of glycerin;
greater than 0.4 percent by weight of citric acid;
between 0.1 to 2.0 percent by weight of plant-based humectant;
a mixture of sodium salts between 0.3 to 2.0 percent by weight; and
a mixture of natural oils between 0.03 to 1.2 percent by weight.

2. The composition of claim 1, wherein the plant-based humectant consists essentially of at least Aloe Vera Gel, Zemea Propanediol, and combinations thereof.

3. The composition of claim 1, wherein the mixture of sodium salts consists essentially of at least Trisodium Citrate, Sodium Gluconate, Sodium Chloride, and combinations thereof.

4. The composition of claim 1, wherein the mixture of natural oils consists essentially of at least one natural oil selected from the group of Australian Tea Tree Oil, Cedarwood Oil, *Eucalyptus* Oil, Lemongrass Oil, Orange Oil, D-limonene Oil, Lavender 40/42 Oil, and combinations thereof.

5. The composition of claim 1, wherein said composition further comprises a secondary foaming boosting surfactant.

6. The composition of claim 1, wherein said composition further comprises a chelating agent selected from the group of Acrylates Copolymer, Glutamic acid/N-diacetic acid/tetra sodium salt, Polyglyceryl-3 Caprate/Caprylate/Succinate, and combinations thereof.

7. The composition of claim 1, wherein said composition contains no additional surfactant, no additional bleaching activator, no additional organic acid, no additional builder, no additional brightener, no manmade detergent, and no additional preservative.

* * * * *